US011781297B1

(12) United States Patent
Rice et al.

(10) Patent No.: US 11,781,297 B1
(45) Date of Patent: Oct. 10, 2023

(54) MULTI-LINE FAUCET WITH UNDERCOUNTER VALVE ASSEMBLY

(71) Applicant: Multipure International, Las Vegas, NV (US)

(72) Inventors: Zachary Rice, Las Vegas, NV (US); Mark Jackson, Fresno, CA (US)

(73) Assignee: Multipure International, Las Vegas, NV (US)

( * ) Notice: Subject to any disclaimer, the term of this patent is extended or adjusted under 35 U.S.C. 154(b) by 0 days.

(21) Appl. No.: 17/981,159

(22) Filed: Nov. 4, 2022

(51) Int. Cl.
*E03C 1/04* (2006.01)

(52) U.S. Cl.
CPC ..... *E03C 1/0412* (2013.01); *E03C 1/0401* (2013.01)

(58) Field of Classification Search
CPC ..... E03C 1/0401
USPC ..... 4/675
See application file for complete search history.

(56) References Cited

U.S. PATENT DOCUMENTS

| | | | | |
|---|---|---|---|---|
| 5,660,203 | A | 8/1997 | Gnauert et al. | |
| 6,738,996 | B1 | 5/2004 | Tanaka | |
| 7,198,059 | B2 | 4/2007 | Kempf et al. | |
| 7,607,449 | B2 | 10/2009 | Herring et al. | |
| 7,814,927 | B2 | 10/2010 | Hansen | |
| 10,184,575 | B2 | 1/2019 | Tasserit et al. | |
| 10,253,484 | B2 | 4/2019 | Bares et al. | |
| 10,640,393 | B2 * | 5/2020 | Cobb | E03C 1/0411 |
| 10,948,101 | B2 | 3/2021 | Morrish et al. | |
| 2007/0028975 | A1 | 2/2007 | Herring et al. | |
| 2007/0004549 | A1 | 3/2007 | Derring et al. | |
| 2014/0116553 | A1 | 5/2014 | Schoolcraft et al. | |
| 2017/0101325 | A1 * | 4/2017 | Ye | B01D 35/046 |
| 2020/0332502 | A1 * | 10/2020 | Rowe | E03C 1/0404 |
| 2021/0017010 | A1 * | 1/2021 | Funke | B67D 1/0882 |
| 2021/0140156 | A1 * | 5/2021 | Rowe | E03C 1/0411 |
| 2023/0139384 | A1 * | 5/2023 | Funke | E03C 1/046 222/23 |

FOREIGN PATENT DOCUMENTS

| | | | |
|---|---|---|---|
| JP | 2626385 | B2 | 4/1997 |
| JP | 2008081989 | A | 4/2008 |
| JP | 2013076212 | A | 4/2013 |

(Continued)

OTHER PUBLICATIONS

International Search Report and Written Opinion in corresponding International Patent Application No. PCT/US22/49010 dated Feb. 15, 2023, 8 pages.

*Primary Examiner* — Huyen D Le
(74) *Attorney, Agent, or Firm* — Greenberg Traurig, LLP; Todd C. Basile

(57) ABSTRACT

A faucet system includes a first assembly configured for positioning above an upper surface of a support, the first assembly including a handle that is movable between an on configuration and an off configuration, a second assembly configured for positioning below a bottom surface of a support, the second assembly including a valve assembly configured to connect to two or more fluid lines; and an elongated member: coupling the second assembly to the first assembly such that moving the handle between the on configuration and the off configuration causes the elongated member to operate the valve assembly, and having a hollow interior defining a fluid pathway between second assembly and the first assembly through which fluid from at least one of the two or more fluid lines is provided to the first assembly when the handle is in the on configuration.

42 Claims, 10 Drawing Sheets

(56) References Cited

FOREIGN PATENT DOCUMENTS

| | | | |
|---|---|---|---|
| JP | 6013716 | B2 | 9/2016 |
| WO | 2006/072250 | A1 | 7/2006 |
| WO | 2022/173889 | A1 | 8/2022 |

* cited by examiner

MULTI-LINE FAUCET WITH UNDERCOUNTER VALVE ASSEMBLY

FIELD

The present disclosure relates generally to the field of faucets. More specifically, the present disclosure relates to multiple-line faucets having an undercounter valve assembly.

BACKGROUND

Sink faucets contain a valve assembly operated by a handle. Turning the handle to the "on" position causes the valve to open, allowing water to flow into the faucet from a supply line and out of the faucet spigot. Turning the handle to the "off" position causes the valve to close, shutting off the flow of water from the supply line. The valve assembly is typically located just above the countertop at the base of the faucet.

Many faucets connect to more than just a supply line; they connect to multiple lines. Because faucet valve assemblies are typically located above the countertop, it is often necessary to cut a larger diameter hole through the countertop in order to route the multiple lines up to the valve assembly from under the countertop. This can be a daunting task for everyday homeowners converting from a single-line faucet to a multiple-line faucet. Likewise, cutting a larger diameter hole in the countertop can limit a homeowner's options when converting back to a single-line faucet, since the hole may have a larger footprint than the base of the homeowner's preferred single-line faucet.

Multiple-line faucets are often used when adding an under-counter appliance such as a reverse osmosis water filtration system. For example, an "air gap" faucet is often used to prevent backflow when the under-counter appliance is connected to both the water supply plumbing and the drain plumbing. Rather than routing wastewater from the under-counter appliance directly to the drain plumbing (which could result in backflow from the drain making its way through the under-counter appliance and into the water supply plumbing), the wastewater is instead first routed through an air gap valve in the faucet valve assembly before it is routed to the drain plumbing. As configured, air gap faucets connect to three lines: (i) a supply line from the filtration system through which filtered water is dispensed, (ii) a drainage line from the filtration system through which wastewater is drained, and (iii) a drainage line from the faucet to the plumbing drain. The valve assembly in most air gap faucets is configured to open/close line (i) only; lines (ii) and (iii) always remain open.

Another type of faucet may be used with under-counter water filtration systems and connects to three lines: (i) an unfiltered water supply line, (ii) a return line to the water filtration system, and (iii) a filtered water supply line from the water filtration system. The valve assembly in such faucets is typically configured to open/close line (i) or line (ii) to cut off water to the filtration system; line (iii) always remains open so as to minimize pressure on the housing of the undercounter appliance.

Each of these multiple-line faucet designs suffers disadvantages. Those configured to open/close only a filtered water supply line leave the under-counter appliance under pressure from the unfiltered water supply line. As such, if the under-counter appliance were to spring a leak, the leak would continue indefinitely since it would be open to a continuous source of water from the unfiltered water supply line. Conversely, those configured to open/close only the unfiltered water supply line leave the under-counter appliance open to the atmosphere via the faucet spigot. Residual pressure inside of the under-counter appliance may cause water to continue to flow out of the faucet spigot after turning the handle to the off position, which can be undesirable and cause users to think the faucet is broken. Likewise, leaving the filtered line open can result in prolonged filter cartridge exposed to the environment outside of the spigot.

SUMMARY

The summary is a high-level overview of various aspects of the present disclosure and introduces some of the concepts that are further detailed in the Detailed Description section below. This summary is not intended to identify key or essential features of the claimed subject matter, nor is it intended to be used in isolation to determine the scope of the claimed subject matter. The subject matter should be understood by reference to the appropriate portions of the entire specification, any or all drawings, and each claim.

Embodiments of the present disclosure relate to a faucet system including a first assembly configured for positioning above an upper surface of a support, the first assembly comprising a handle that is movable between an on configuration and an off configuration. The system also includes a second assembly configured for positioning below a bottom surface of a support, the second assembly including a valve assembly configured to connect to two or more fluid lines. The system also includes an elongated member coupling the second assembly to the first assembly such that moving the handle between the on configuration and the off configuration causes the elongated member to operate the valve assembly and having a hollow interior defining a fluid pathway between second assembly and the first assembly through which fluid from at least one of the two or more fluid lines is provided to the first assembly when the handle is in the on configuration.

In some embodiments, the support includes a hole extending between the upper surface and the bottom surface, wherein the elongated member is configured to extend through the hole.

In some embodiments, a diameter of the elongated member is less than a combined diameter of the two or more fluid lines.

In some embodiments, the support is a countertop.

In some embodiments, the first assembly further includes a faucet base configured to be mounted to the upper mounting surface of the support, where each of the handle and the faucet arm are coupled to the faucet base.

In some embodiments, the system further includes a handle spool positioned within the faucet base and coupling the handle to the mechanical linkage, and the elongated member is fluidly connected to the faucet arm via the handle spool when the handle is moved to the on configuration.

In some embodiments, the elongated member has a first end and a second end, the first end is coupled to the handle spool, the second end is couple to the valve assembly, and the elongated member translates movement of the handle to the valve assembly.

In some embodiments, the first end of the elongated member is keyed for insertion into a first keyed hole in the handle spool, and the second end of the elongated member is keyed for insertion into a second keyed hole in the valve assembly.

In some embodiments, the valve assembly includes a rotating valve component coupled to the elongated member such that the rotating valve component rotates when the handle is moved between the on configuration and the off configuration.

In some embodiments, the valve assembly further includes a static valve component, and a bottom surface of the rotating valve component is positioned against an upper surface of the static valve component.

In some embodiments, the static valve component defines fluid connections between the two or more fluid lines and the rotating valve component.

In some embodiments, the rotating valve component includes a keyed bottom surface configured to provide one or more fluid connections between at least one of the two or more fluid lines and the hollow interior of the elongated member when the handle is moved to the on configuration.

In some embodiments, the two or more fluid lines include an unfiltered fluid supply line, a return line to a filtration system, and a filtered fluid line from the filtration system, where the rotating valve component includes: a first channel configured to provide a first fluid connection between the unfiltered fluid supply line and the return line when the handle is in the on configuration, and a second channel configured to provide a second fluid connection between the filtered fluid supply line and the hollow interior of the elongated member when the handle is in the on configuration.

In some embodiments, when the handle is in the off configuration, the first channel and the second channel are positioned so as to terminate the first fluid connection and the second fluid connection.

In some embodiments, terminating the first fluid connection prevents unfiltered fluid from the unfiltered fluid supply line from entering the filtration system, and terminating the second fluid connection prevents filtered fluid from the filtered fluid line from entering the elongated member.

Embodiments of the present disclosure also relate to a fluid dispensing system including a filtration system configured for positioning below a support. The filtration system also includes a faucet system including a valve assembly configured for positioning below the support, the valve assembly configured to connect to an unfiltered fluid supply line, a return line to the filtration system, and a filtered fluid line from the filtration system. The faucet system also includes a handle configured for positioning above the support, the handle being mechanically coupled to the valve assembly such that moving the handle operates the valve assembly between an on configuration and an off configuration. The faucet system also includes a faucet arm configured for positioning above the support, the faucet arm being connected to the valve assembly by one or more fluid conduits, where, in the on configuration, the valve assembly permits fluid communication between (i) the unfiltered fluid supply line and the return line, and (ii) the filtered supply line and the faucet arm, and where, in the off configuration, the valve assembly terminates fluid communication between (i) the unfiltered fluid supply line and the return line, and (ii) the filtered supply line and the faucet arm via the one or more fluid conduits.

In some embodiments, the one or more fluid conduits provide the mechanical coupling between the handle and the valve assembly such that (i) the one or more fluid conduits translate movement of the handle to movement of the valve assembly and (ii) the filtered fluid travels from the valve assembly to the faucet arm through the one or more fluid conduits.

In some embodiments, in the on configuration, (i) unfiltered fluid from the unfiltered fluid supply line is provided to the filtration system via the return line and (ii) filtered fluid from the filtration system is provided to the faucet arm via the one or more fluid conduits, the foregoing combining to permit continuous filtration of unfiltered fluid and dispensing of filtered fluid.

In some embodiments, in the off configuration, (i) unfiltered fluid from the unfiltered fluid supply line is prevented from entering the return line such that only that unfiltered fluid present already present within the return line can enter the filtration system, and (ii) filtered fluid from the filtration system is prevented from entering the one or more fluid conduits such that pressurized filtered fluid within the filtration system does not escape through the faucet arm.

In some embodiments, terminating fluid communication between the unfiltered fluid supply line and the return line limits any leakage from the filtration system to that finite amount of fluid already present in the filtration system at the time the valve assembly was moved to the off configuration.

BRIEF DESCRIPTION OF THE DRAWINGS

The accompanying drawings are included to provide a further understanding of the disclosure and are incorporated in and constitute a part of this specification, illustrate embodiments, and together with the description serve to explain the principles of the present disclosure.

DETAILED DESCRIPTION

Figure 1:
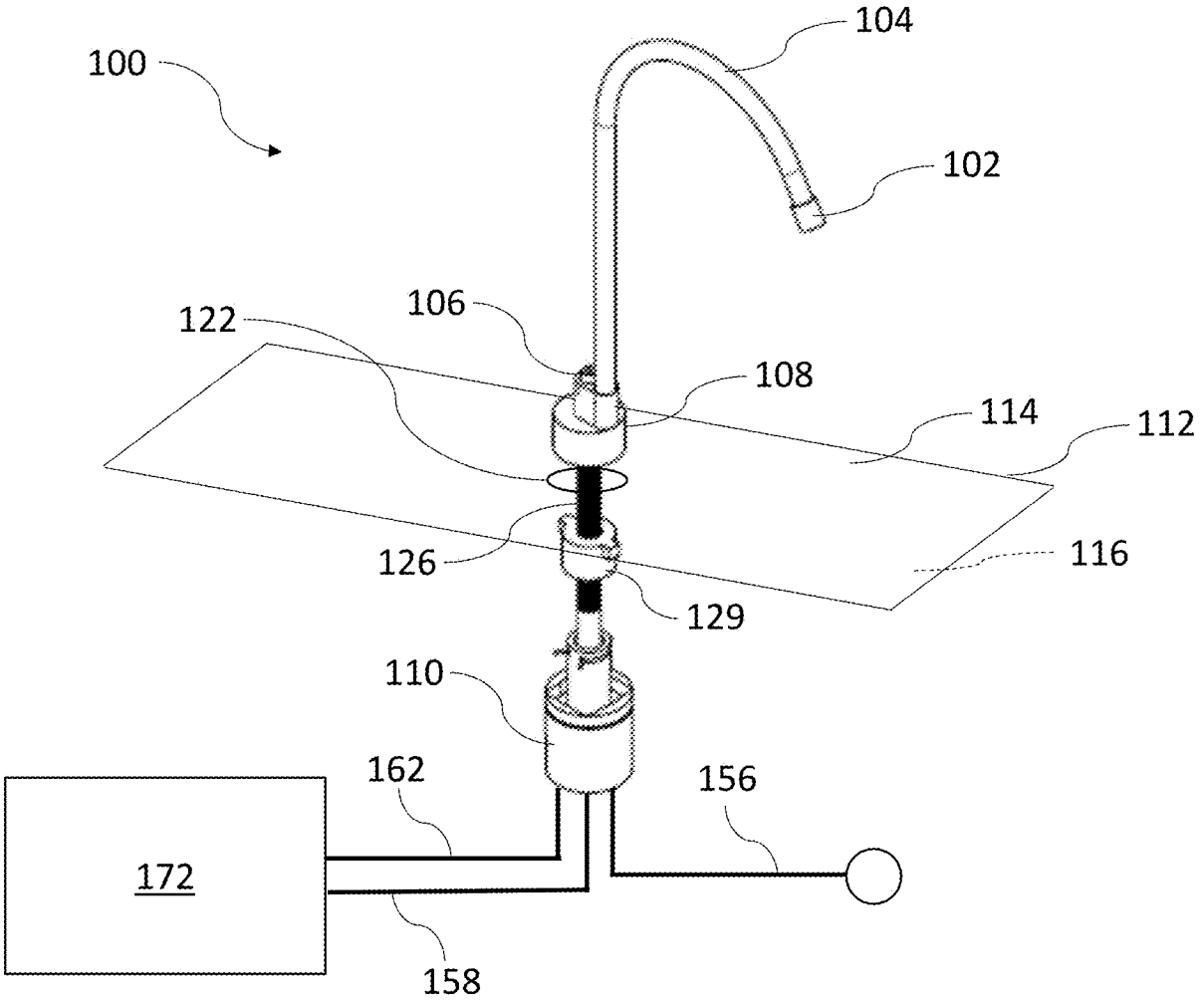
FIG. 1 is a perspective view of a faucet system, according to embodiments of the present disclosure.

The following description provides exemplary embodiments only, and is not intended to limit the scope, applicability, or configuration of the disclosure. Rather, the following description of the exemplary embodiments will provide those skilled in the art with an enabling description for implementing one or more exemplary embodiments. It will be understood that various changes may be made in the function and arrangement of elements without departing from the spirit and scope of the presently disclosed embodiments. Embodiment examples are described as follows with reference to the figures. Identical, similar, or identically acting elements in the various figures are identified with identical reference numbers and a repeated description of these elements is omitted in part to avoid redundancies.

Among those benefits and improvements that have been disclosed, other objects and advantages of the present disclosure will become apparent from the following description taken in conjunction with the accompanying figures. Detailed embodiments of the present disclosure are disclosed herein; however, it is to be understood that the disclosed embodiments are merely illustrative of the present disclosure that may be embodied in various forms. In addition, each of the examples given in connection with the various embodiments of the present disclosure which are intended to be illustrative, and not restrictive.

Throughout the specification and claims, the following terms take the meanings explicitly associated herein, unless the context clearly dictates otherwise. The phrases "in one embodiment" and "in some embodiments" as used herein do not necessarily refer to the same embodiment(s), though it may. Furthermore, the phrases "in another embodiment" and "in some other embodiments" as used herein do not necessarily refer to a different embodiment, although it may. Thus, as described below, various embodiments of the present disclosure may be readily combined, without departing from the scope or spirit of the present disclosure.

In addition, as used herein, the term "or" is an inclusive "or" operator and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

The term "based on" is not exclusive and allows for being based on additional factors not described, unless the context clearly dictates otherwise. In addition, throughout the specification, the meaning of "a," "an," and "the" include plural references. The meaning of "in" includes "in" and "on." Spatial or directional terms, such as "left", "right", "inner", "outer", "above", "below", and the like, are not to be considered as limiting as the present disclosure can assume various alternative orientations. All numbers used in the specification are to be understood as being modified in all instances by the term "about". The term "about" means a range of plus or minus ten percent of the stated value.

With reference to FIGS. 1-14, in some embodiments, the present disclosure relates to a faucet system with an under-counter valve assembly that is mechanically linked to and operable via an above-counter handle. In some embodiments, the faucet system is a multiple-line faucet system that includes a filtered water supply line. In some embodiments, turning the handle turns the valve assembly. In some embodiments, when the handle is turned to the "on" position, filtered water flows from the valve assembly, through a hollow interior of an elongated member and up the faucet base, where the filtered water is diverted into the faucet arm.

FIG. 1 depicts a faucet system 100 according to embodiments of the present disclosure, isolated from its mounting position, such as, for example, next to a sink. As shown in FIG. 1, in various embodiments, the faucet system 100 includes an above-counter assembly and a below-counter assembly. Above-counter assembly, in various embodiments, may generally include a spigot 102, a faucet arm 104, a handle 106, and a faucet base 108. Below-counter assembly, in various embodiments, may include a valve assembly 110 configured to receive an unfiltered water supply line 156, a return line 158, and a filtered water supply line 162. Return line 158 and filtered water supply line 162 may connect to a filtration system 172, as shown.

Faucet base 108 is configured to mount to an upper mounting surface of a support 112, such as a sink or countertop, to secure the faucet system 100 to the support. In some embodiments, the support 112 includes a hole 122 sized and shaped such that elements of the faucet system 100, such as shank 126 and elongated member 132 situated therewithin, may pass from the below-counter assembly to the above-counter assembly, as will be described in further detail below. In some embodiments, shank 126 may have external threading and may extend through the hole 122 in the support 112. A first end 128 of shank 126 may couple to the under-counter assembly (e.g., to valve assembly 110) and a second end 130 of shank 126 may couple to the above-counter assembly (e.g., to faucet base 108). In some embodiments, the threaded shank 126 extends through a slip nut 129, which is tightened against the lower mounting surface 116 of the support 112 to hold the above countertop assembly firmly in place against the upper mounting surface 114 of the support 112. Threaded shank 126, in some embodiments, may further act as a protective conduit for other components of the faucet system 100, such as elongated member 132 situated therein as shown in FIG. 2.

Faucet arm 104, in various embodiments, may be a hollow member having a first end 118 (e.g., the inlet end) fluidly connected to a second end 120 (e.g., the outlet end) via a fluid passageway 124. In some embodiments, as depicted in FIG. 1, the faucet arm 104 may be J-shaped; however, in other embodiments, the faucet arm 104 may be any other shape. First end 118 may couple to the faucet base 108 and second end 120 may couple to or form spigot 102, which may be configured to influence the configuration (e.g., shape or pattern) of the water emitted from the second end 120 of the faucet arm 104.

Figure 2:
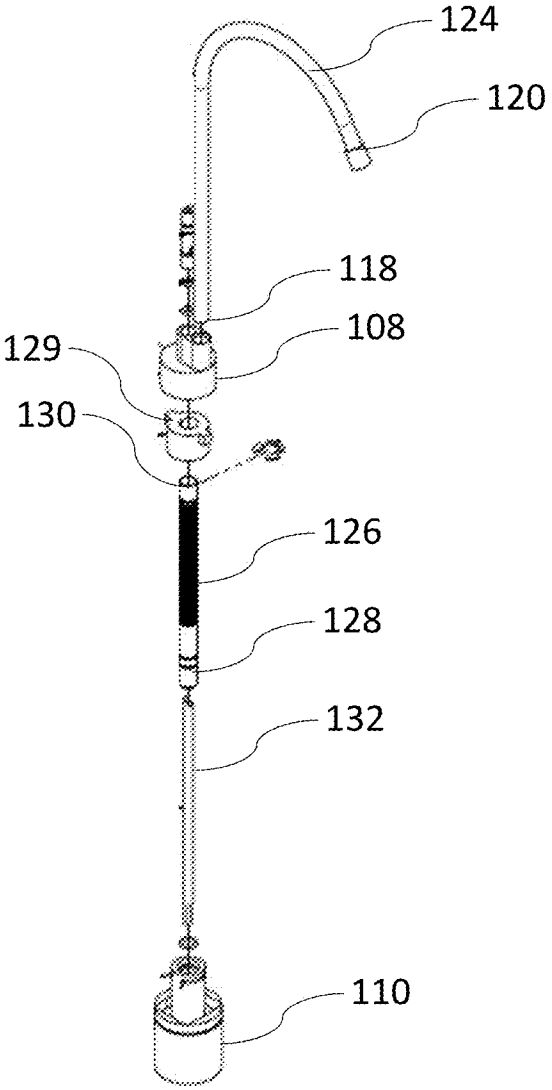
FIG. 2 is an exploded view of the faucet system of FIG. 1, according to embodiments of the present disclosure.
Figure 4:
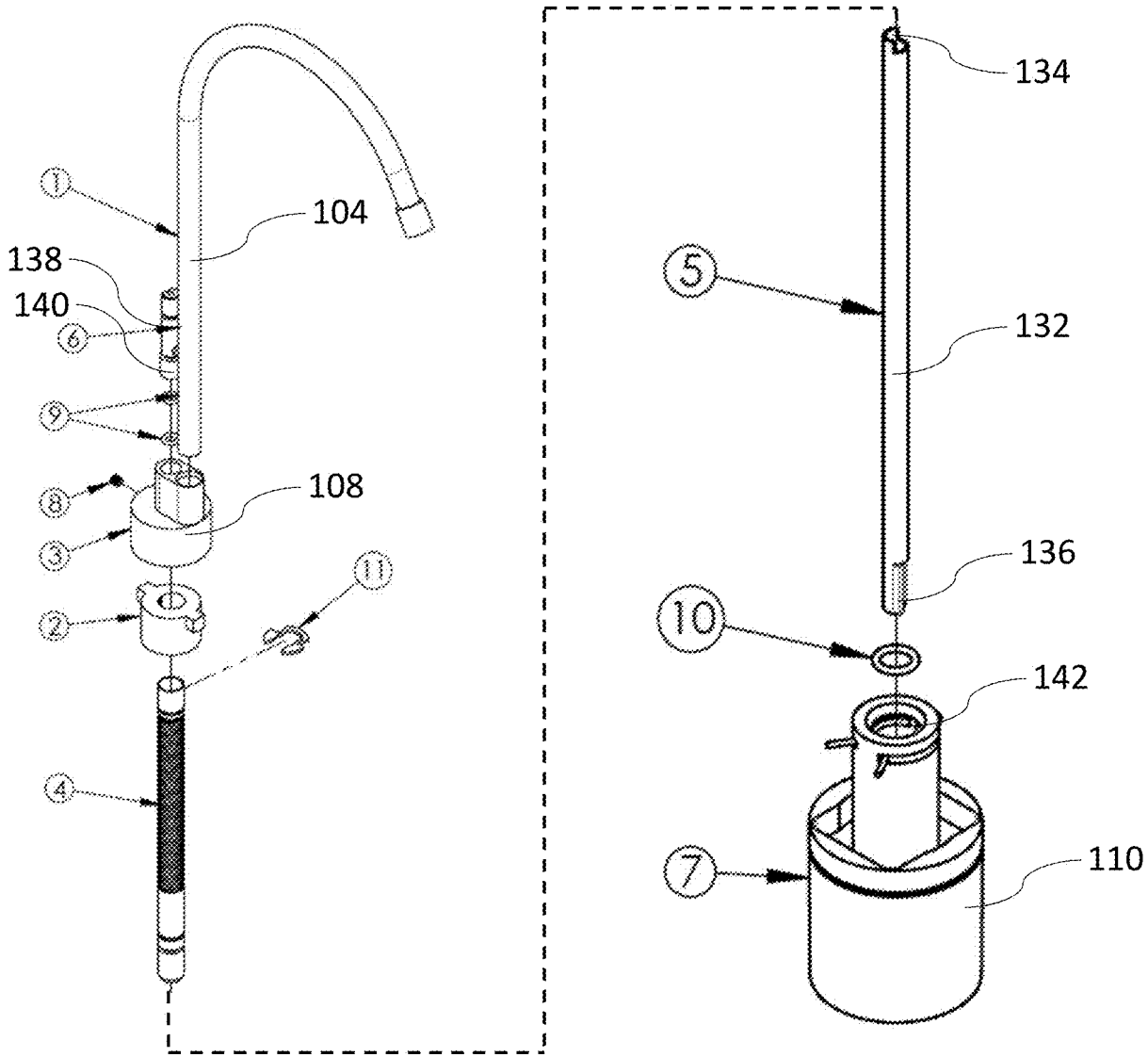
FIG. 4 is an exploded view of the faucet system of FIG. 1, according to embodiments of the present disclosure.
Figure 5:
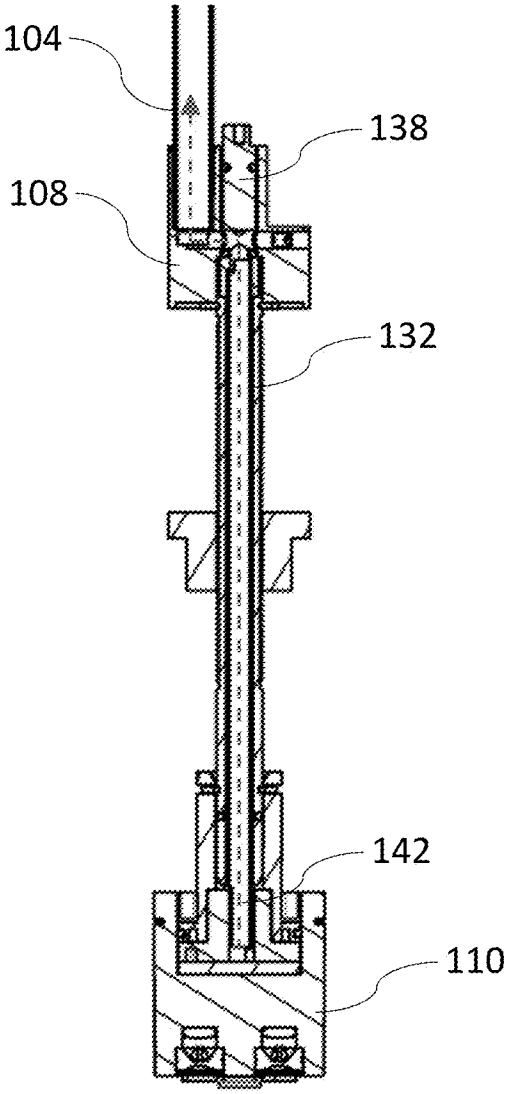
FIG. 5 is a cross-sectional view of a portion of the faucet system of FIG. 1, according to embodiments of the present disclosure.
Figure 6:
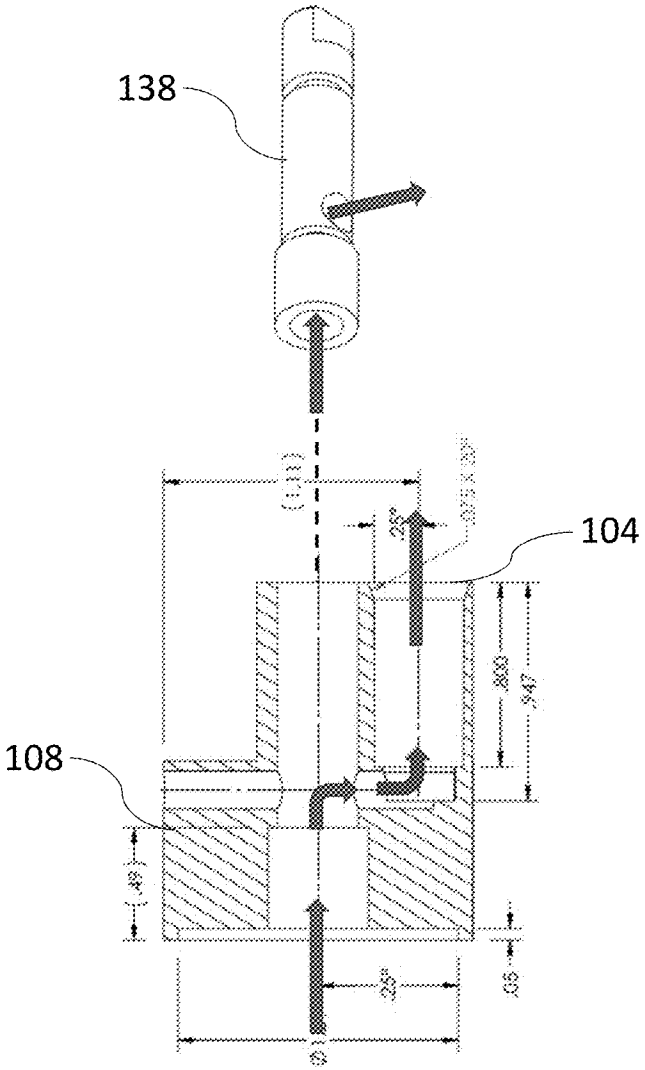
FIG. 6 is a cross-sectional view of a faucet base of the faucet system FIG. 1, according to embodiments of the present disclosure.
Figure 7:
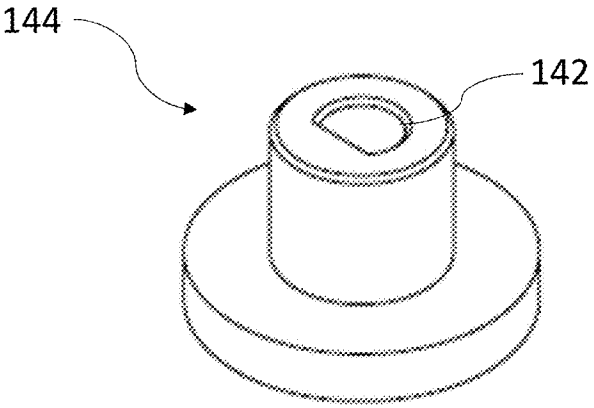
FIG. 7 is a perspective view of a rotating valve component of the faucet system of FIG. 1, according to embodiments of the present disclosure.

Handle 106, in various embodiments, may be mechanically coupled to the valve assembly 110 via an elongated member 132 that extends through a hollow interior of the threaded shank 126, as depicted in FIG. 2 and FIG. 4. In various embodiments, elongated member 132 may have structural properties that allow it to withstand torsional forces applied thereto by handle 106 (applied torsional forces) and valve assembly 110 (reactional torsional forces) without bending or buckling. For example, elongated member 132 may be substantially rigid, and in various embodiments, may be made of metal or another suitably strong material and have a sufficient wall thickness to withstand such torsional forces. One having ordinary skill in the art will recognize suitable materials and construction of elongated member 132 for these purposes without undue experimentation. A first end 134 of the elongated member 132 may be keyed for insertion into a keyed hole 140 in a handle spool 138 of the handle 106, as depicted in FIGS. 4-5. A second end 136 may be keyed for insertion into a keyed hole 142 in a rotating valve component 144 of the valve assembly 110, as depicted in FIG. 7 and as will be described in further detail below. For example, in some embodiments, as depicted in FIG. 4, each of the first end 134 and the second end 136 may have a d-shaped profile to be inserted into d-shaped keyed holes 140, 142, respectively. In other embodiments, the first end 134 and the second end 136 may have any profile shape, so long as the profiles correspond with the shape of the keyed holes or otherwise secure firmly such that rotation of handle 106 causes rotation of rotating valve component 144 without slipping.

Handle 106, in various embodiments, may be configured to provide multi-directional control of the flow rate of water through the faucet arm 104 and out the spigot 102 of the faucet system. In some embodiments the handle 106 may be rotatable about one or more axes to control the flow rate of water. For example, in some embodiments, rotating the handle 106 in a first direction, about an axis, moves the handle 106 to the "on" position, allowing water to flow through the faucet system 100. Conversely, rotating the handle 106 in a second, opposing direction, about the same axis, moves the handle 106 to the "off" position, stopping water flow through the faucet system 100. In some embodiments, the handle 106 may be rotatable about another axis to change the temperature of the water flowing through the faucet system 100.

Figure 11:
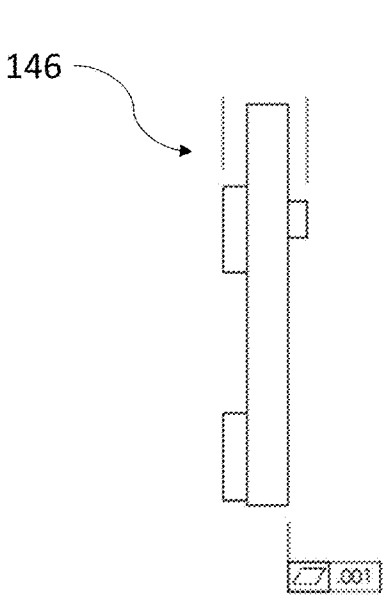
FIG. 11 is a side view of the static valve component, according to embodiments of the present disclosure.
Figure 10:
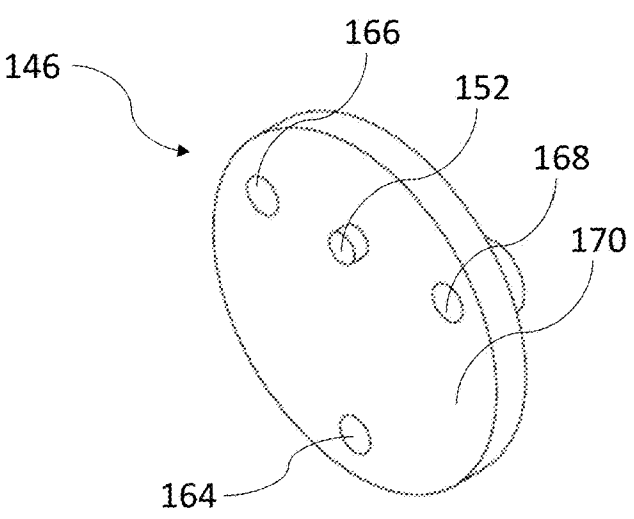
FIG. 10 is a top isometric view of the static valve component, according to embodiments of the present disclosure.
Figure 9:
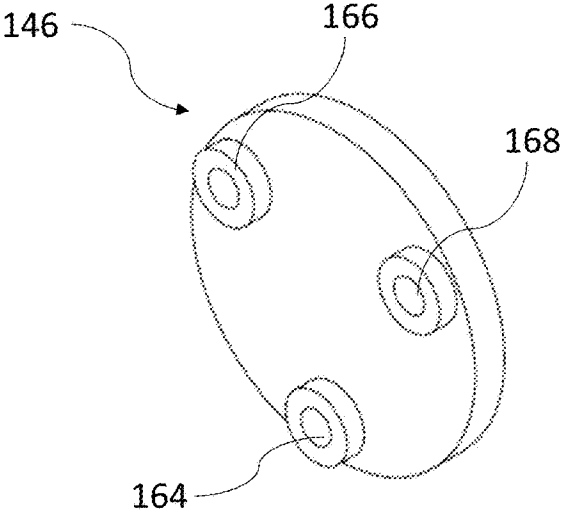
FIG. 9 is a bottom isometric view of a static valve component of the faucet system of FIG. 1, according to embodiments of the present disclosure.

Valve assembly 110, in various embodiments, may include a rotating valve component 144 and a static valve component 146. In some embodiments, the static valve component 146 provides an interface between the unfiltered water supply line 156, the return line 158, the filtered water supply line 162, and the rotating valve component 144. In some embodiments, as depicted in FIGS. 9-11, three ports are configured to align with the three water lines 156, 158, 162 and provide conduits that open up into the channels of the rotating valve component 144 when the handle 106 is in the "on" position. In some embodiments, the static valve component 146 includes an unfiltered supply line port 164, a return line port 166 and a filtered supply line port 168. As discussed previously, in some embodiments, the static valve component 146 also includes the guide peg 152, which extends upwardly from an upper surface 170 of the static valve component 146 to fit in and cooperate with the guide groove 150 of the rotating valve component 144.

Figure 3:
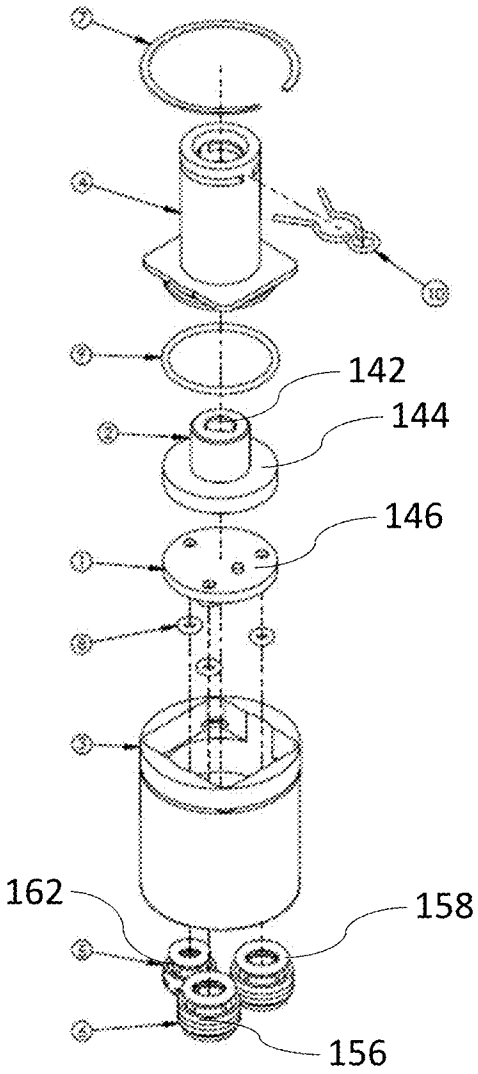
FIG. 3 is an exploded view of a valve assembly of the faucet system of FIG. 1, according to embodiments of the present disclosure.
Figure 8:
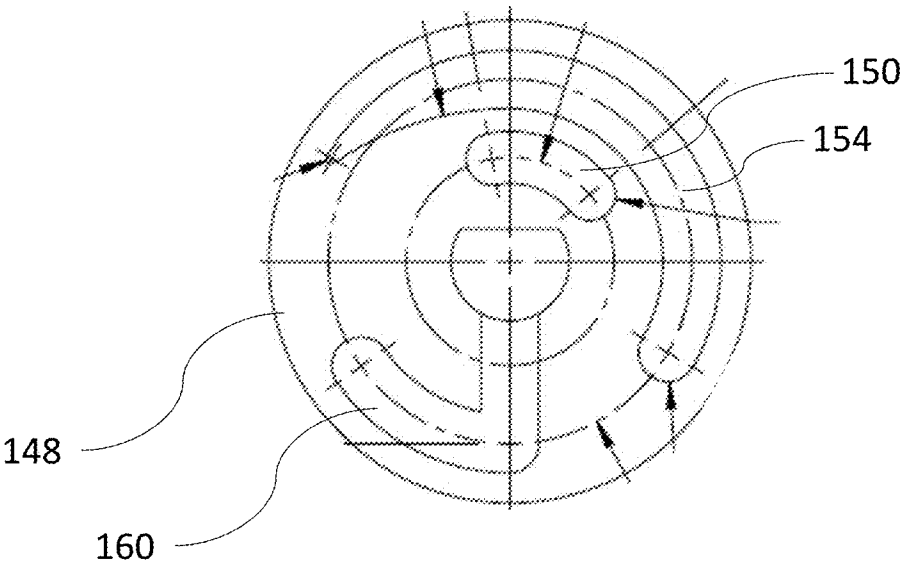
FIG. 8 is a bottom view of the rotating valve component, according to embodiments of the present disclosure.

In some embodiments, the rotating valve component 144 couples to the elongated member 132 such that the rotating valve component 144 rotates when the handle 106 is rotated. A bottom surface 148 of rotating valve component 144 may be positioned against an upper surface 170 of the static valve component 146, as depicted in FIG. 3, such that the rotating valve component 144 mechanically interacts with the static valve component 146 via a guide peg 152 of the static valve component 146, as will be described in further detail below. As depicted in FIG. 8, in some embodiments, the rotating valve component 144 includes a keyed bottom surface 148 including a guide groove 150 and at least two channels 154, 160 configured to place various combinations of lines 156, 158, and 162 in fluid communication with one another and other components of system 100, as later described in more detail. Guide groove 150 may receive the guide peg 152 projecting up from the static valve component 146 and defines end stops for rotation of the rotating valve component 144. That is, as the guide peg 152 moves through the guide groove 150, rotation in either direction is stopped when the guide peg 152 approaches the ends of the guide groove 150.

First channel 154, in various embodiments, may be configured to provide a fluid connection between a unfiltered water supply line 156 and a return line 158 when the handle 106 is in the "on" position. For example, in some embodiments, the when the handle 106 is in the "on" position, the first channel 154 is moved to a position such that a fluid connection is opened between the unfiltered water supply line 156 and a ceramic valve of the valve assembly 110, allowing fluid flow into the valve assembly 110. Further, when the handle is in the "on" position, the first channel 154 is also moved to a position such that a fluid connection is opened between the valve assembly 110 and the return line 158, allowing fluid flow from the valve assembly 110 into the return line 158. Thus, moving the handle 106 to the "on" position provides a fluid connection between the unfiltered water supply line 156 and the return line 158, via the first channel 154.

Second channel 160, in various embodiments, may be configured to provide a fluid connection between a filtered water supply line 162 and the faucet arm 104 when the handle 106 is in the "on" position. For example, in some embodiments, when the handle 106 is in the "on" position, second channel 160 is moved to a position such that a fluid connection is opened between the filtered water line 162 and keyed hole 142 of rotating valve component 144. Filtered water may follow this fluid connection up through keyed hole 142 where it then enters a hollow interior of elongated member 132. The filtered water then flows up through the handle spool 138, into the faucet arm 104, and out through the spigot 102.

Figure 14:
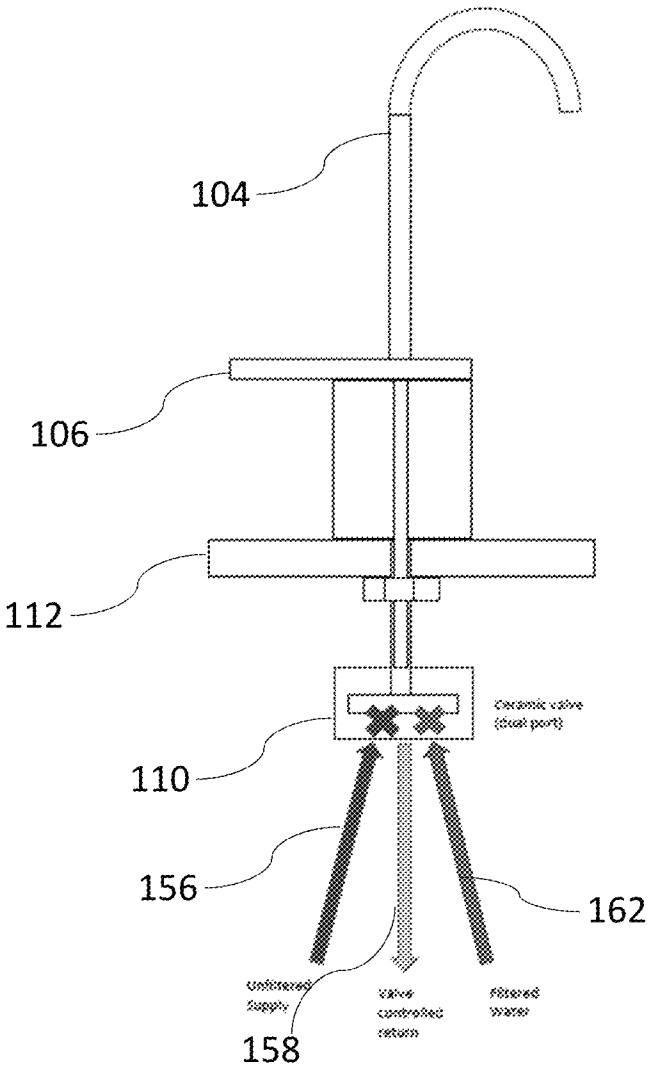
FIG. 14 is another schematic view of the faucet system, according to embodiments of the present disclosure.
Figure 13:
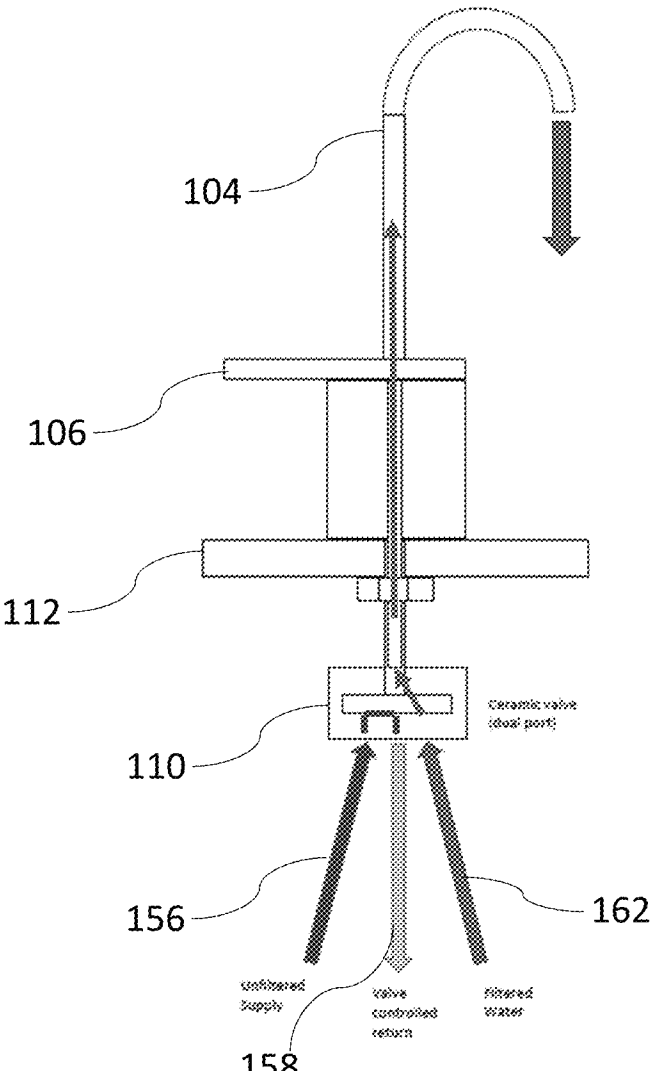
FIG. 13 is another schematic view of the faucet system, according to embodiments of the present disclosure.

In some embodiments, when the handle 106 is turned to the "off" position, the handle spool 138 and elongated member 132 are rotated, in turn rotating the rotating valve component 144 to a position in which the filtered water supply line 162 is closed, as depicted in FIG. 14. Additionally, in some embodiments, when the handle 106 is in the "off" position, at least one of the unfiltered water supply line 156 or the return line 158 is closed. As a result, no unfiltered water enters into the filtration system 172 and no filtered water from the filtration system 172 enters into the elongated member 132.

Figure 12:
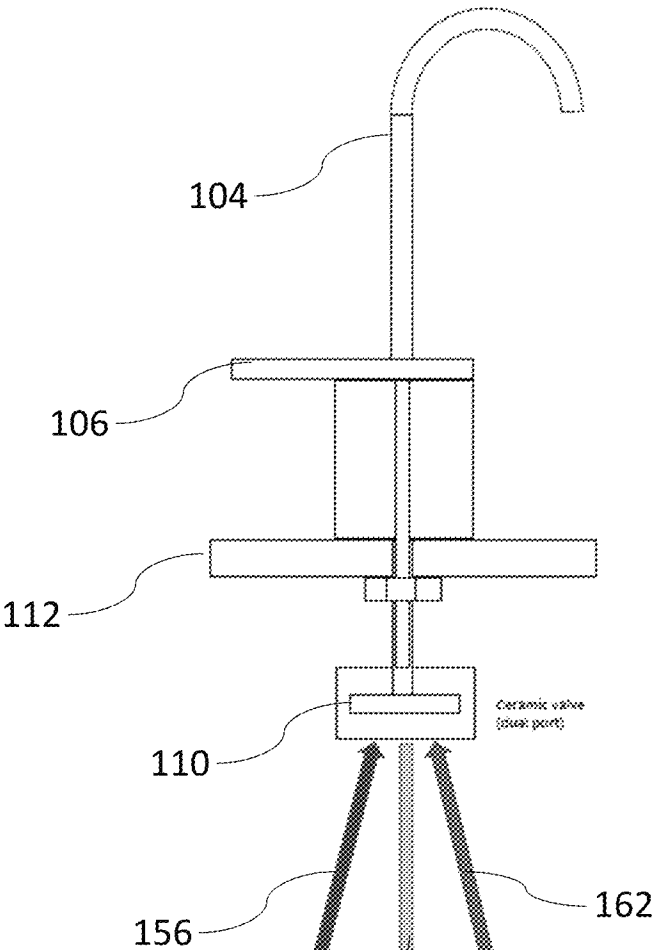
FIG. 12 is a schematic view of the faucet system, according to embodiments of the present disclosure.

In use, in some embodiments, when the handle 106 is turned to the "on" position, the handle spool 138 and elongated member 132 are rotated, in turn rotating the rotating valve component 144 to a position in which each of the unfiltered water supply line 156, the return line 158, the filtered water supply line 162 are open, as depicted in FIG. 12. In some embodiments, when each of the lines 156, 158, 162 are open, water from the unfiltered water supply line 156 is directed into the return line 158, which directs the water into a filtration system 172. In some embodiments, once water is filtered, the filtered water then exits the filtration system 172 and is directed into the valve assembly 110 via the filtered water supply line 162.

This configuration has several advantages. First, by closing off the supply of unfiltered water to the filtration system 172, the filtration system 172 is not under continuous pressure from the unfiltered water supply line 156 when the handle is in the "off" position. As such, if the filtration system 172 springs a leak, the only water that will leak out is that which was trapped within the filtration system 172 when the faucet system 100 was turned off. The trapped water is a relatively small, finite amount of water compared with a continuous, indefinite amount of water that could leak were the unfiltered water supply line 156 or return line 158 open.

Second, by closing off the escape of filtered water into the faucet system 100, the filtration system 172 is no longer exposed to the external environment outside of the spigot 102. In one aspect, this prevents "afterflow," a phenomena that occurs when a pressure buildup within the filtration system 172 causes filtered water to flow out of the filtration system 172, into the faucet arm 104, and out of the spigot 102 even after the unfiltered water supply line 156 is cut off. But for the valve assembly 110 closing off the filtered water supply line 162, afterflow could last for 5-10 seconds after the handle 106 is turned to the "off" position, which may be undesirable and potentially make the user think the faucet system 100 is broken. In another aspect, by closing off the filtered water supply line 162, a filter cartridge of the filtration system 172 will not be exposed to the environment outside of the spigot 102 for prolonged periods of time.

Third, by locating valve assembly 110 under support 112, multiple lines (e.g., unfiltered water supply line 156, return line 158, and filtered water line 162 need not be routed up through hole 122 in support 112. More specifically, most such lines originate below support 112 (e.g., unfiltered water supply line 156 coming from under-counter plumbing and filtered water line 162 coming from under-counter filtration system 172) or connect to things below support 112 (e.g., return line 158 connecting to under-counter filtration system 172) and, as such, are typically routed through hole 122 to connect to the valves of traditional above-counter faucet systems. As previously explained, it is often necessary to cut a larger diameter hole through the countertop in order to route the multiple lines therethrough. This can be a daunting task for everyday homeowners converting from a single-line faucet to a multiple-line faucet. Likewise, cutting a larger diameter hole in the countertop can limit a homeowner's options when converting back to a single-line faucet, since the hole may have a larger footprint than the base of the homeowner's preferred single-line faucet. Instead, in the present configuration, the multiple lines remain below-counter and only a single fluid conduit—e.g., the hollow interior of elongated member 132—need be routed through hole 122 to carry filtered water to faucet arm 104. The outer diameter of this fluid conduit can necessarily be much smaller than the collective outer diameter of the multiple lines (156, 158, 162) and, in some embodiments, may be similar in diameter to that of filtered water line 162 since it is the filtered water from filtered water line 162 being carried through the fluid conduit.

Further, by combining this fluid conduit with a mechanical linkage for mechanically operating under-counter valve assembly 110 via above-counter handle 106 into a single structure (e.g., elongate member 132), the diameter of hole 122 can likewise be minimized. Conversely, existing systems having an under-counter valve assembly are either (i) electronically controlled from above support 12 (e.g., via a touch or motion sensor) such that the valve assembly is operated electronically (e.g., via a motor or electro-mechanical actuator) or (ii) mechanically controlled, but via a separate mechanism routed alongside such fluid conduit, thereby increasing the collective diameter of those components which must be routed through hole 122 and thus increasing the required diameter of hole 122.

As such, faucet system 100 of the present disclosure permits the diameter of shank 126, as well as that of hole 122 in support 112, to be smaller than existing designs, thereby mitigating or even eliminating the downsides of traditional above-counter faucet systems described above.

It should be recognized that faucet system 100 is not intended to be limited to use with water only, but rather may be adapted without undue experimentation based on the present disclosure for use with any suitable fluid. Likewise, faucet system 100 is not intended for use solely with water filtration systems, but rather may be adapted without undue experimentation based on the present disclosure for use with other suitable under-counter appliances and hookups. These examples are merely illustrative and used throughout for ease of explanation.

The disclosure of this application has been described above both generically and with regard to specific embodiments. It will be apparent to those skilled in the art that various modifications and variations can be made in the embodiments without departing from the scope of the disclosure. Thus, it is intended that the embodiments cover the modifications and variations of this invention provided they come within the scope of the appended claims and their equivalents.

What is claimed is:

1. A faucet system comprising:

a first assembly configured for positioning above an upper surface of a support, the first assembly comprising a handle that is movable between an on configuration and an off configuration;

a second assembly configured for positioning below a bottom surface of a support, the second assembly comprising a valve assembly configured to connect to two or more fluid lines, the two or more fluid lines comprise an unfiltered fluid supply line, a return line to a filtration system, and a filtered fluid line from the filtration system; and an elongated member:

coupling the second assembly to the first assembly such that moving the handle between the on configuration and the off configuration causes the elongated member to operate the valve assembly, and having a hollow interior defining a fluid pathway between second assembly and the first assembly through which fluid from at least one of the two or more fluid lines is provided to the first assembly when the handle is in the on configuration, wherein the valve assembly comprises a rotating valve component coupled to the elongated member such that the rotating valve component rotates when the handle is moved between the on configuration and the off configuration, and wherein the rotating valve component comprises:

a first channel configured to provide a first fluid connection between the unfiltered fluid supply line and the return line when the handle is in the on configuration, and a second channel configured to provide a second fluid connection between the filtered fluid supply line and the hollow interior of the elongated member when the handle is in the on configuration.

2. The faucet system of claim 1, wherein the support comprises a hole extending between the upper surface and the bottom surface, wherein the elongated member is configured to extend through the hole.

3. The faucet system of claim 1, wherein a diameter of the elongated member is less than a combined diameter of the two or more fluid lines.

4. The faucet system of claim 1, wherein the support is a countertop.

5. The faucet system of claim 1, wherein the first assembly further comprises a faucet base configured to be mounted to the upper mounting surface of the support, and wherein each of the handle and a faucet arm are coupled to the faucet base.

6. The faucet system of claim 5, further comprising a handle spool positioned within the faucet base and coupling the handle to the elongated member, and wherein the elongated member is fluidly connected to the faucet arm via the handle spool when the handle is moved to the on configuration.

7. The faucet system of claim 6, wherein the elongated member has a first end and a second end, wherein the first end is coupled to the handle spool, wherein the second end is couple to the valve assembly, wherein the elongated member translates movement of the handle to the valve assembly.

8. The faucet system of claim 7, wherein the first end of the elongated member is keyed for insertion into a first keyed hole in the handle spool, and wherein the second end of the elongated member is keyed for insertion into a second keyed hole in the valve assembly.

9. The faucet system of claim 1, wherein the valve assembly further comprises a static valve component, and wherein a bottom surface of the rotating valve component is positioned against an upper surface of the static valve component.

10. The faucet system of claim 9, wherein the static valve component defines fluid connections between the two or more fluid lines and the rotating valve component.

11. The faucet system of claim 10, wherein the rotating valve component comprises a keyed bottom surface configured to provide one or more fluid connections between at least one of the two or more fluid lines and the hollow interior of the elongated member when the handle is moved to the on configuration.

12. The faucet of claim 1, wherein, when the handle is in the off configuration, the first channel and the second channel are positioned so as to terminate the first fluid connection and the second fluid connection.

13. The faucet of claim 12, wherein terminating the first fluid connection prevents unfiltered fluid from the unfiltered fluid supply line from entering the filtration system, and wherein terminating the second fluid connection prevents filtered fluid from the filtered fluid line from entering the elongated member.

14. A fluid dispensing system comprising:

a filtration system configured for positioning below a support;

a faucet system comprising:

a valve assembly configured for positioning below the support, the valve assembly configured to connect to an unfiltered fluid supply line, a return line to the filtration system, and a filtered fluid line from the filtration system;

a handle configured for positioning above the support, the handle being mechanically coupled to the valve assembly such that moving the handle operates the valve assembly between an on configuration and an off configuration; and a faucet arm configured for positioning above the support, the faucet arm being connected to the valve assembly by one or more fluid conduits, wherein, in the on configuration, the valve assembly permits fluid communication between (i) the unfiltered fluid supply line and the return line, and (ii) the filtered supply line and the faucet arm, and wherein, in the off configuration, the valve assembly terminates fluid communication between (i) the unfiltered fluid supply line and the return line, and (ii) the filtered supply line and the faucet arm via the one or more fluid conduits.

15. The fluid dispensing system of claim 14, wherein the one or more fluid conduits provide the mechanical coupling between the handle and the valve assembly such that (i) the one or more fluid conduits translate movement of the handle to movement of the valve assembly and (ii) the filtered fluid travels from the valve assembly to the faucet arm through the one or more fluid conduits.

16. The fluid dispensing system of claim 14, wherein in the on configuration, (i) unfiltered fluid from the unfiltered fluid supply line is provided to the filtration system via the return line and (ii) filtered fluid from the filtration system is provided to the faucet arm via the one or more fluid conduits, the foregoing combining to permit continuous filtration of unfiltered fluid and dispensing of filtered fluid.

17. The fluid dispensing system of claim 14, wherein in the off configuration, (i) unfiltered fluid from the unfiltered fluid supply line is prevented from entering the return line such that only that unfiltered fluid present already present within the return line can enter the filtration system, and (ii) filtered fluid from the filtration system is prevented from entering the one or more fluid conduits such that pressurized filtered fluid within the filtration system does not escape through the faucet arm.

18. The fluid dispensing system of claim 14, wherein terminating fluid communication between the unfiltered fluid supply line and the return line limits any leakage from the filtration system to that finite amount of fluid already present in the filtration system at the time the valve assembly was moved to the off configuration.

19. A faucet system comprising:

a first assembly configured for positioning above an upper surface of a support, the first assembly comprising a handle that is movable between an on configuration and an off configuration and a faucet base configured to be mounted to the upper mounting surface of the support, wherein each of the handle and a faucet arm are coupled to the faucet base;

a second assembly configured for positioning below a bottom surface of a support, the second assembly comprising a valve assembly configured to connect to two or more fluid lines;

an elongated member:

coupling the second assembly to the first assembly such that moving the handle between the on configuration and the off configuration causes the elongated member to operate the valve assembly, and having a hollow interior defining a fluid pathway between second assembly and the first assembly through which fluid from at least one of the two or more fluid lines is provided to the first assembly when the handle is in the on configuration; and a handle spool positioned within the faucet base and coupling the handle to the elongated member, wherein the elongated member is fluidly connected to the faucet arm via the handle spool when the handle is moved to the on configuration, wherein the elongated member has a first end and a second end, the first end being coupled to the handle spool and the second end being coupled to the valve assembly, and the elongated member translates movement of the handle to the valve assembly.

20. The faucet system of claim 19, wherein the support comprises a hole extending between the upper surface and the bottom surface, wherein the elongated member is configured to extend through the hole.

21. The faucet system of claim 19, wherein a diameter of the elongated member is less than a combined diameter of the two or more fluid lines.

22. The faucet system of claim 19, wherein the support is a countertop.

23. The faucet system of claim 19, wherein the first end of the elongated member is keyed for insertion into a first keyed hole in the handle spool, and wherein the second end of the elongated member is keyed for insertion into a second keyed hole in the valve assembly.

24. The faucet system of claim 19, wherein the valve assembly comprises a rotating valve component coupled to the elongated member such that the rotating valve component rotates when the handle is moved between the on configuration and the off configuration.

25. The faucet system of claim 24, wherein the valve assembly further comprises a static valve component, and wherein a bottom surface of the rotating valve component is positioned against an upper surface of the static valve component.

26. The faucet system of claim 25, wherein the static valve component defines fluid connections between the two or more fluid lines and the rotating valve component.

27. The faucet system of claim 26, wherein the rotating valve component comprises a keyed bottom surface configured to provide one or more fluid connections between at least one of the two or more fluid lines and the hollow interior of the elongated member when the handle is moved to the on configuration.

28. The faucet system of claim 24, wherein the two or more fluid lines comprise an unfiltered fluid supply line, a return line to a filtration system, and a filtered fluid line from the filtration system, wherein the rotating valve component comprises:

a first channel configured to provide a first fluid connection between the unfiltered fluid supply line and the return line when the handle is in the on configuration, and a second channel configured to provide a second fluid connection between the filtered fluid supply line and the hollow interior of the elongated member when the handle is in the on configuration.

29. The faucet of claim 28, wherein, when the handle is in the off configuration, the first channel and the second channel are positioned so as to terminate the first fluid connection and the second fluid connection.

30. The faucet of claim 29, wherein terminating the first fluid connection prevents unfiltered fluid from the unfiltered fluid supply line from entering the filtration system, and wherein terminating the second fluid connection prevents filtered fluid from the filtered fluid line from entering the elongated member.

31. A faucet system comprising:

a first assembly configured for positioning above an upper surface of a support, the first assembly comprising a handle that is movable between an on configuration and an off configuration;

a second assembly configured for positioning below a bottom surface of a support, the second assembly comprising a valve assembly configured to connect to two or more fluid lines; and an elongated member:

coupling the second assembly to the first assembly such that moving the handle between the on configuration and the off configuration causes the elongated member to operate the valve assembly, and having a hollow interior defining a fluid pathway between second assembly and the first assembly through which fluid from at least one of the two or more fluid lines is provided to the first assembly when the handle is in the on configuration, wherein the valve assembly comprises:

a rotating valve component coupled to the elongated member such that the rotating valve component rotates when the handle is moved between the on configuration and the off configuration, and a static valve component, wherein a bottom surface of the rotating valve component is positioned against an upper surface of the static valve component and the static valve component defines fluid connections between the two or more fluid lines and the rotating valve component.

32. The faucet system of claim 31, wherein the support comprises a hole extending between the upper surface and the bottom surface, wherein the elongated member is configured to extend through the hole.

33. The faucet system of claim 31, wherein a diameter of the elongated member is less than a combined diameter of the two or more fluid lines.

34. The faucet system of claim 31, wherein the support is a countertop.

35. The faucet system of claim 31, wherein the first assembly further comprises a faucet base configured to be mounted to the upper mounting surface of the support, and wherein each of the handle and a faucet arm are coupled to the faucet base.

36. The faucet system of claim 35, further comprising a handle spool positioned within the faucet base and coupling the handle to the elongated member, and wherein the elongated member is fluidly connected to the faucet arm via the handle spool when the handle is moved to the on configuration.

37. The faucet system of claim 36, wherein the elongated member has a first end and a second end, wherein the first end is coupled to the handle spool, wherein the second end is couple to the valve assembly, wherein the elongated member translates movement of the handle to the valve assembly.

38. The faucet system of claim 37, wherein the first end of the elongated member is keyed for insertion into a first keyed hole in the handle spool, and wherein the second end of the elongated member is keyed for insertion into a second keyed hole in the valve assembly.

39. The faucet system of claim 31, wherein the rotating valve component comprises a keyed bottom surface configured to provide one or more fluid connections between at least one of the two or more fluid lines and the hollow interior of the elongated member when the handle is moved to the on configuration.

40. The faucet system of claim 31, wherein the two or more fluid lines comprise an unfiltered fluid supply line, a return line to a filtration system, and a filtered fluid line from the filtration system, wherein the rotating valve component comprises:

a first channel configured to provide a first fluid connection between the unfiltered fluid supply line and the return line when the handle is in the on configuration, and a second channel configured to provide a second fluid connection between the filtered fluid supply line and the hollow interior of the elongated member when the handle is in the on configuration.

41. The faucet of claim 40, wherein, when the handle is in the off configuration, the first channel and the second channel are positioned so as to terminate the first fluid connection and the second fluid connection.

42. The faucet of claim 41, wherein terminating the first fluid connection prevents unfiltered fluid from the unfiltered fluid supply line from entering the filtration system, and wherein terminating the second fluid connection prevents filtered fluid from the filtered fluid line from entering the elongated member.

* * * * *